US008532327B2

(12) United States Patent
Omori et al.

(10) Patent No.: US 8,532,327 B2
(45) Date of Patent: Sep. 10, 2013

(54) DIAPHRAGM AND SPEAKER DEVICE PROVIDED WITH THE SAME

(75) Inventors: Tatsuya Omori, Kyoto (JP); Shuhei Yamasaki, Osaka (JP)

(73) Assignee: Panasonic Corporation, Osaka (JP)

( * ) Notice: Subject to any disclaimer, the term of this patent is extended or adjusted under 35 U.S.C. 154(b) by 41 days.

(21) Appl. No.: 13/177,187

(22) Filed: Jul. 6, 2011

(65) Prior Publication Data

US 2012/0148085 A1 Jun. 14, 2012

(30) Foreign Application Priority Data

Dec. 8, 2010 (JP) ..... 2010-273158

(51) Int. Cl.
*H04R 1/00* (2006.01)

(52) U.S. Cl.
USPC ..... 381/423; 381/424; 181/173; 181/174

(58) Field of Classification Search
USPC ..... 381/423, 424; 181/173, 174
See application file for complete search history.

(56) References Cited

U.S. PATENT DOCUMENTS 1,870,417 A * 8/1932 Mallina ..... 181/170
3,983,337 A * 9/1976 Babb ..... 381/407
4,086,450 A * 4/1978 Inoue ..... 181/173
7,315,628 B2 1/2008 Kuribayashi et al.
7,845,461 B2 * 12/2010 Imamura et al. ..... 181/167

FOREIGN PATENT DOCUMENTS

JP 60-047597 3/1985
JP 2005-123779 5/2005

OTHER PUBLICATIONS

Yamamoto, "Speaker System", Radio Technology, 1977.

* cited by examiner

*Primary Examiner* — Davetta W Goins
*Assistant Examiner* — Amir Etesam
(74) *Attorney, Agent, or Firm* — Hamre, Schumann, Mueller & Larson, P.C.

(57) ABSTRACT

A diaphragm is provided with a plurality of thick portions radially from an inner circumferential side to an outer circumferential side. The thick portions are composed of at least two kinds having different lengths in a radiation direction and formed to be gradually thinner in the radiation direction from the inner circumferential side to the outer circumferential side. With this configuration, separate vibrations in the diaphragm can be suppressed. Further, a speaker device provided with the diaphragm having the above-described configuration can reproduce sounds faithfully in accordance with input signals.

2 Claims, 7 Drawing Sheets

DIAPHRAGM AND SPEAKER DEVICE PROVIDED WITH THE SAME

BACKGROUND

1. Field

The disclosure of the present application relates to a diaphragm and a speaker device provided with the same.

2. Description of Related Art

The conventional speaker device includes a drive system equipped mainly with a magnetic circuit and a voice coil, a diaphragm for vibrating air, and a support system for supporting the diaphragm. A cone-type speaker device (for the bass reproduction, full-range reproduction, etc.) and a dome-type speaker (for the treble reproduction) are known generally as a speaker device with the above-described configuration.

JP 2005-123779 A discloses a technique for improving fluctuations in a sound pressure frequency response, especially in a treble part, by providing thick parts having different thicknesses at several locations on a cone-type diaphragm.

JP 60 (1985)-47597 A discloses a technique of making a cone-type diaphragm gradually thinner from the center to the outer circumferential side for reducing the weight of the diaphragm.

Thus, the conventional speaker device is able to reproduce music with good sound quality by improving the diaphragm.

However, as described in Non-Patent Document 1 ("Speaker System" written by Takeo Yamamoto, Radio Technology, published in 1977), when vibrations having frequencies from the midrange (about 2 kHz) to the treble (about 20 kHz) are applied on a common diaphragm for a cone-type speaker device, separate vibrations sometimes occur, which worsens the quality of output sounds. Specifically, since the strength of the conventional diaphragm on the outer circumferential side is not sufficient, separate vibrations in a circumferential direction occur on the outer circumferential side when midrange signals are input. Further, since the strength of the conventional diaphragm on the inner circumferential side is not sufficient, separate vibrations in the circumferential direction occur on the inner circumferential side when treble signals are input. Moreover, in specific frequencies in the midrange and the treble, separate vibrations in a radiation direction sometimes occur. Because of these influences, in the conventional speaker device, there has been a problem that large peaks and dips occur in the sound pressure frequency response and fluctuations occur in sounds. Note here that "separate vibration" refers to the motion by which the diaphragm vibrates while bending.

Further, the thick parts of the diaphragm disclosed in JP 2005-123779 A have a uniform length, and parts other than the thick parts are made gradually thinner from the outer circumferential side to the inner circumferential side. With this configuration, although fluctuations in the sound pressure frequency response are reduced, the decrease in the strength of the diaphragm on the inner circumferential side reduces the sound pressure in the treble. Therefore, such a configuration is not suitable for enlarging a reproduction band in the treble.

SUMMARY

A diaphragm disclosed in the present application is a diaphragm provided with a plurality of thick portions radially from an inner circumferential side to an outer circumferential side, wherein the thick portions are composed of at least two kinds of thick portions having different lengths in a radiation direction and formed to be gradually thinner in the radiation direction from the inner circumferential side to the outer circumferential side.

A speaker device disclosed in the present application is a speaker device including: a magnet; a moving coil that is displaceable in a first direction based on an input current and magnetic flux generated by the magnet; and a diaphragm that is displaceable in the first direction together with the moving coil, wherein the diaphragm is provided with a plurality of thick portions radially from an inner circumferential side to an outer circumferential side, and the thick portions are composed of at least two kinds of thick portions having different lengths in a radiation direction and formed to be gradually thinner in the radiation direction from the inner circumferential side to the outer circumferential side.

DETAILED DESCRIPTION OF THE EMBODIMENT (Embodiment)

[1. Configuration of the Speaker Device]

Figure 1:
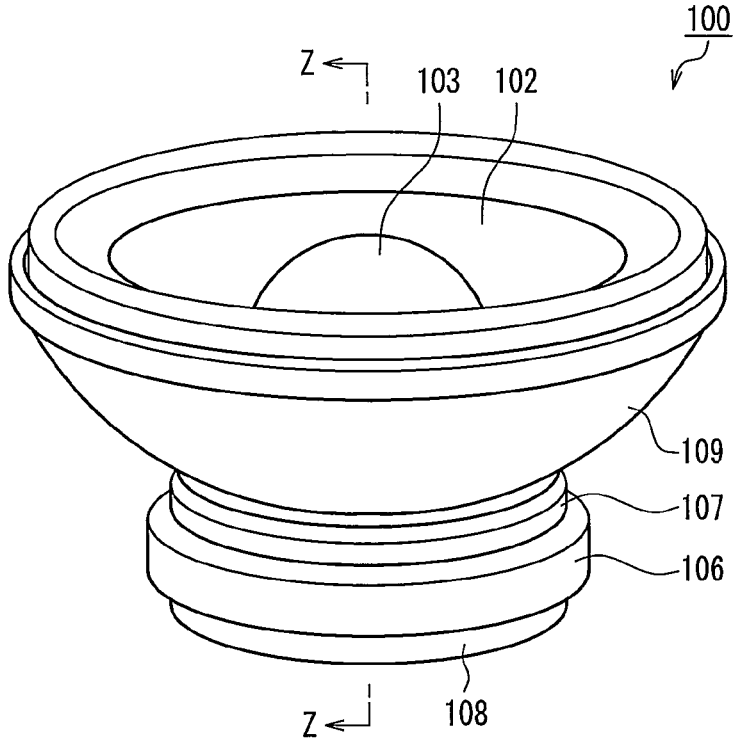
FIG. 1 is a perspective view of a speaker device according to the present embodiment.
Figure 2:
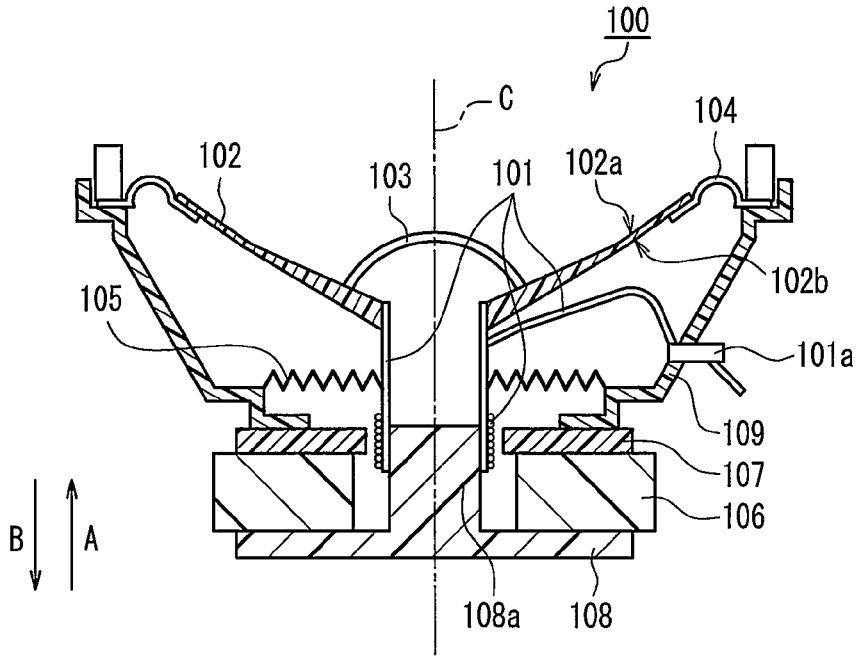
FIG. 2 is a cross-sectional view of the speaker device according to the present embodiment.

FIG. 1 is a perspective view of a speaker device according to the present embodiment. FIG. 2 is a cross-sectional view taken along a line Z-Z in FIG. 1.

A speaker device 100 is provided with a voice coil 101, a diaphragm 102, a dust cap 103, an edge member 104, a damper member 105, a magnet 106, a top plate 107, a bottom plate 108 and a frame 109.

The voice coil 101 is supported by the bottom plate 108 so as to be displaceable in a direction indicated by an arrow A or B. The voice coil 101 has a winding portion, which is arranged in a magnetic field of the magnet 106. The diaphragm 102 is fixed to one end portion of the voice coil 101. The voice coil 101 has a terminal 101*a*. When a current (sound signal) is applied to the voice coil 101 from the outside through the terminal 101*a*, an electromagnetic force is caused between magnetic flux generated by the voice coil 101 and the magnet 106, thereby causing the voice coil 101 to be displaced in the direction indicated by the arrow A or B. When an alternating current is input to the terminal 101*a*, the voice coil 101 is displaced (vibrates) back and forth in the directions indicated by the arrows A and B in accordance with the direction of the alternating current.

The diaphragm 102 is formed in a substantially cone shape. Since the diaphragm 102 is fixed to the voice coil 101, the diaphragm 102 is displaced (vibrates) in the direction indicated by the arrow A or B in accordance with the displacement (vibration) of the voice coil 101. The displacement (vibration) of the diaphragm 102 in the direction indicated by the arrow A or B vibrates the ambient air, whereby sound waves are emitted in the air. Although the material is not limited, the diaphragm 102 can be formed of a resin, pulp, metal, glass fiber, etc. In the present embodiment, the diaphragm 102 is formed of polypropylene mixed with mica. Although in the present embodiment the diaphragm 102 has a cone shape including a perfect circle, it may have a cone shape including an ellipse or a pyramid shape. Further, a dashed line C shown in FIG. 2 is a centerline of the speaker device or the diaphragm 102. In each member provided in the speaker device, the side close to the centerline C is defined as "inner circumferential side" and the side away from the centerline C is defined as "outer circumferential side". For example, "inner circumferential side" of the diaphragm 102 includes an end portion on the side close to the centerline C and its vicinity, and "outer circumferential side" of the diaphragm 102 includes an end portion on the side away from the centerline C and its vicinity.

The dust cap 103 is a member formed in a part-spherical shape using a resin, metal, etc. The dust cap 103 is fixed on the inner circumferential side of the diaphragm 102 for stabilizing the vibration of the diaphragm 102, and blocks an opening formed on the inner circumferential side of the diaphragm 102 for preventing the intrusion of foreign substances from the outside. Note here that the material and the shape of the dust cap 103 described herein are merely examples.

The edge member 104 is a member formed in a ring shape using a resin, etc. The inner circumferential side of the edge member 104 is fixed to the diaphragm 102 and the outer circumferential side thereof is fixed to the frame 109. In order not to prevent the desired displacement (vibration) of the diaphragm 102, the edge member 104 preferably is formed of a flexible material. The edge member 104 stabilizes the vibration of the diaphragm 102. Note here that the material and the shape of the edge member 104 described herein are merely examples.

The damper member 105 is a member formed in a pleated disc shape using a resin, etc. The inner circumferential side of the damper member 105 is fixed to the voice coil 101 and the outer circumferential side thereof is fixed to the frame 109. In order not to prevent the desired displacement (vibration) of the diaphragm 102, the damper member 105 preferably is formed of a flexible material. The damper member 105 stabilizes the vibration of the diaphragm 102. Note here that the material and the shape of the damper member 105 described herein are merely examples.

The magnet 106 is fixed to the bottom plate 108. It is preferable to use a permanent magnet such as a ferrite magnet and a neodymium magnet as the magnet 106. The magnet 106 is formed in a ring shape. A part of the voice coil 101 and a part of the bottom plate 108 are arranged in the opening on the inner circumferential side.

The top plate 107 is fixed to the magnet 106.

The bottom plate 108 is arranged in the lowermost part of the speaker device 100, and a columnar protrusion 108*a* formed in the center on the inner circumferential side supports the voice coil 101.

The frame 109 fixes the diaphragm 102 and a drive system composed of the magnet 106, top plate 107 and bottom plate 108.

In the speaker device 100 shown in FIGS. 1 and 2, when an alternating current (sound signal) is input to the terminal 101*a*, an electromagnetic force is caused based on the input alternating current and the magnetic flux generated by the magnet 106, thereby causing the voice coil 101 to be displaced in the directions indicated by the arrows A and B. Since the diaphragm 102 is fixed to the voice coil 101, the diaphragm 102 is displaced in the directions indicated by the arrows A and B in accordance with the displacement of the voice coil 101. The displacement of the diaphragm 102 in the directions indicated by the arrows A and B vibrates the air around the diaphragm 102, whereby sounds are emitted. In other words, by vibrating air, the diaphragm 102 emits sound waves in the air.

[2. Configuration of the Diaphragm 102]

Figure 3:
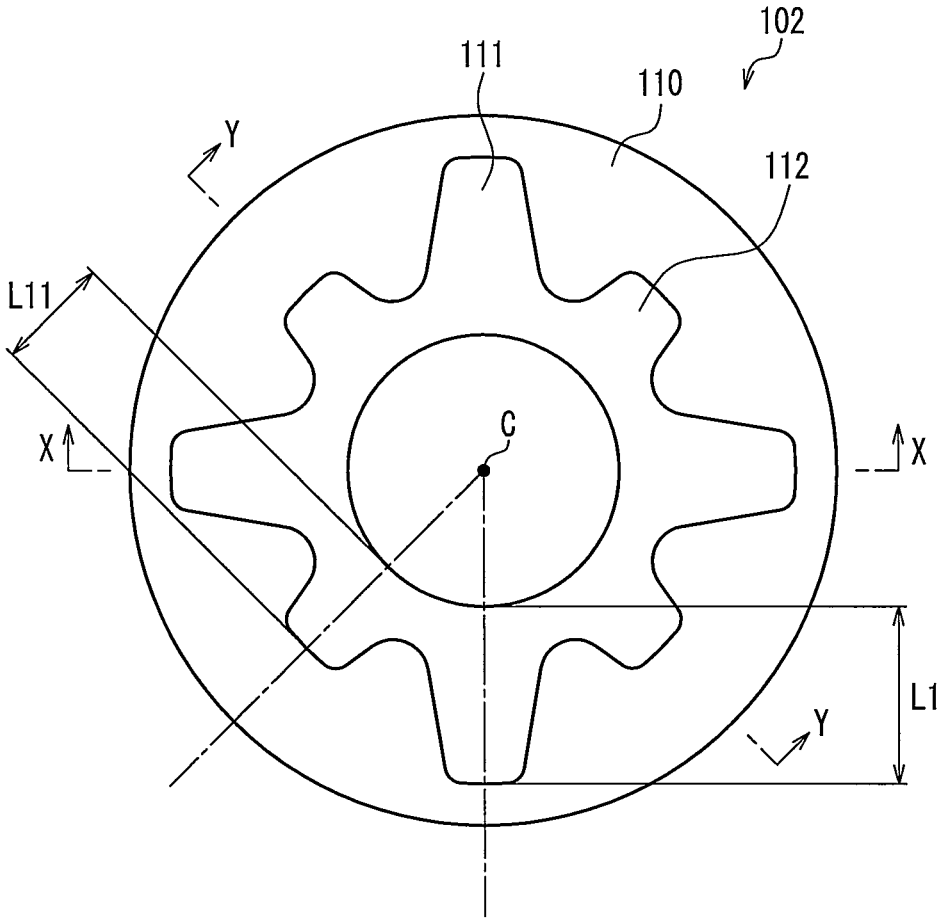
FIG. 3 is a plan view showing an exemplary diaphragm according to the present embodiment.
Figure 4:
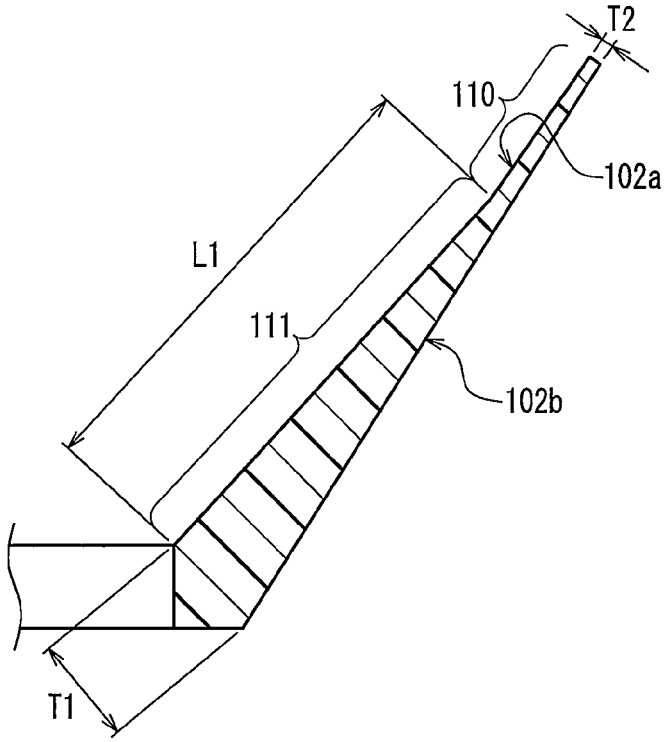
FIG. 4 is a cross-sectional view of a long thick portion in the diaphragm.
Figure 5:
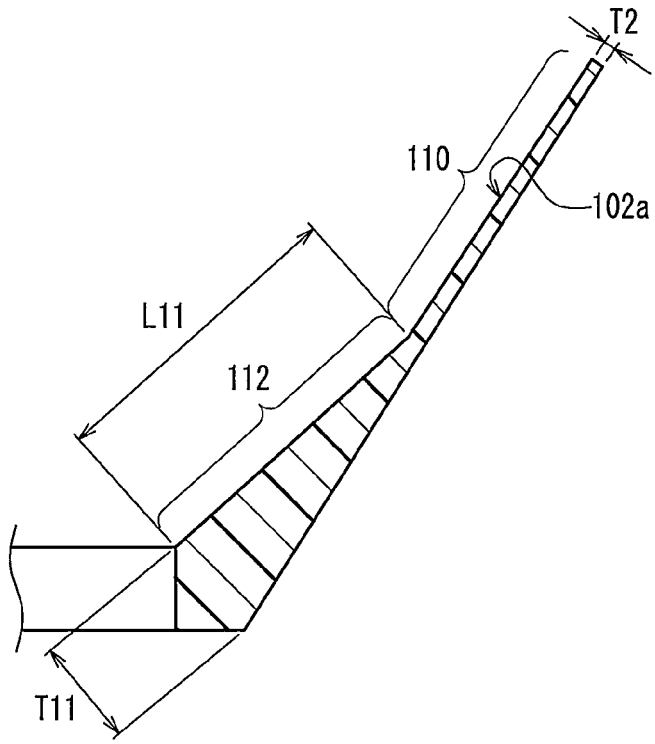
FIG. 5 is a cross-sectional view of a short thick portion in the diaphragm.

FIG. 3 is a plan view of the diaphragm 102. FIG. 4 is a cross-sectional view taken along a line X-X in FIG. 3. FIG. 5 is a cross-sectional view taken along a line Y-Y in FIG. 3.

The diaphragm 102 includes a thin portion 110, long thick portions 111 and short thick portions 112.

The thickness of the thin portion 110 is uniform. The thin portion 110 is provided mainly on the outer circumferential side of the diaphragm 102.

As shown in FIG. 3, the long thick portions 111 are formed in a radiation direction (radially) from the centerline C of the diaphragm 102. Although in the present embodiment four long thick portions 111 are provided at equal intervals, the number and the interval dimension are not limited to the configuration of the present embodiment. A length L1 of the long thick portion 111 from the inner circumferential side to the outer circumferential side is longer than a length L11 of the short thick portion 112 from the inner circumferential side to the outer circumferential side. As shown in FIG. 4, the long thick portion 111 is formed on a surface 102*a* of the diaphragm 102. A thickness T1 of the long thick portion 111 is made gradually thinner from the inner circumferential side to the outer circumferential side. The thickness of the long thick portion 111 on the outer circumferential side is the same as a thickness T2 of the thin portion 110. Note here that the length L1 and the thickness T1 of the long thick portion 111 can be determined arbitrarily depending on a desired frequency response and specifications of other members.

As shown in FIG. 3, the short thick portions 112 are formed in the radiation direction (radially) from the centerline C of the diaphragm 102. Although in the present embodiment four short thick portions 112 are provided at equal intervals, the number and the interval dimension are not limited to the configuration of the present embodiment. As shown in FIG. 5, the short thick portion 112 is formed on the surface 102*a* of the diaphragm 102. A thickness T11 of the short thick portion 112 is made gradually thinner from the inner circumferential side to the outer circumferential side. The thickness of the short thick portion 112 on the outer circumferential side is the same as the thickness T2 of the thin portion 110. Note here that the length L11 and the thickness T11 of the short thick portion 112 can be determined arbitrarily depending on a desired frequency response and specifications of other members.

Note here that "gradually thinner" described in the present specification is not limited to the configuration in which the thickness of the diaphragm 102 is made continuously smaller from the inner circumferential side to the outer circumferential side as shown FIG. 4, and includes a configuration in which the thickness of the diaphragm 102 is made stepwise smaller from the inner circumferential side to the outer circumferential side (step-like configuration).

Further, in the present embodiment, the long thick portions 111 and the short thick portions 112 are formed on the surface 102*a* of the diaphragm 102, but the same effect can be obtained even if they are formed on a back face 102*b* (back side of the surface 102*a*) of the diaphragm 102. Further, the same effect can be obtained even if one of the long thick portion 111 and the short thick portion 112 is formed on the surface 102*a* of the diaphragm 102, and the other is formed on the back face 102*b* of the diaphragm 102.

Further, although in the present embodiment the long thick portions 111 and the short thick portions 112 respectively are formed at four locations, there is no limitation to the number as long as they are formed at least at one location.

Figure 6:
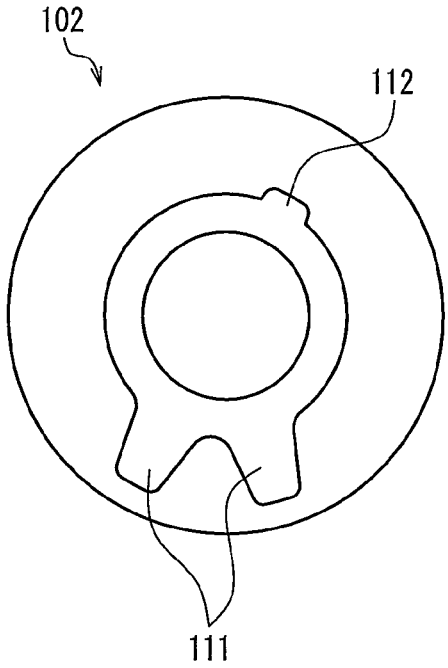
FIG. 6 is a plan view showing a modification example of the diaphragm.

Further, although in the present embodiment the number of each of the long thick portions 111 and the short thick portions 112 is an even number, it may be an odd number. For example, as shown in FIG. 6, two long thick portions 111 and one short thick portion 112 may be formed. Incidentally, FIG. 6 is a plan view showing a modification example of the diaphragm 102.

Further, in the present embodiment, the long thick portions 111 and the short thick portions 112 may be arranged symmetrically with respect to a line segment passing through the centerline C, or may be arranged asymmetrically.

Figure 7:
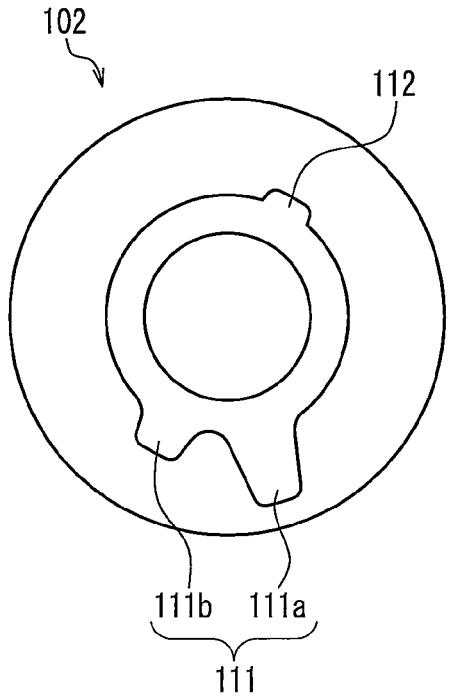
FIG. 7 is a plan view showing a modification example of the diaphragm.

Further, the long thick portion 111 and the short thick portion 112 can be set arbitrarily in accordance with the size or the material of the diaphragm 102. For example, as shown in FIG. 7, the long thick portion 111 may be composed of a first long thick portion 111*a* and a second long thick portion 111*b* shorter than the first long thick portion 111*a*. Incidentally, FIG. 7 is a plan view showing a modification example of the diaphragm 102.

Further, in the configuration shown in FIG. 3, the long thick portions 111 are extended close to an end portion of the diaphragm 102 on the outer circumferential side, but may be formed to reach the end portion.

Hereinafter, the motion of the diaphragm 102 in the present embodiment will be described.

The diaphragm 102 of the present embodiment is mechanically reinforced from the inner circumferential side to the outer circumferential side by having the long thick portions 111 from the inner circumferential side to the outer circumferential side. In other words, the long thick portions 111 enhance the strength of the diaphragm 102. With this configuration, it is possible to reduce separate vibrations occurring on the outer circumferential side of the diaphragm 102.

Further, the inner circumferential side of the diaphragm 102 is mechanically reinforced by having the short thick portions 112. In other words, the short thick portions 112 enhance the strength of the diaphragm 102. With this configuration, it is possible to reduce separate vibrations occurring on the inner circumferential side of the diaphragm 102.

Further, since the long thick portions 111 and the short thick portions 112 of the diaphragm 102 are formed to be gradually thinner from the inner circumferential side to the outer circumferential side, the strength on the inner circumferential side and the strength on the outer circumferential side are different from each other. With this configuration, it is possible to reduce separate vibrations occurring in the radiation direction in the diaphragm 102.

Since the diaphragm 102 of the present embodiment has the long thick portions 111 and the short thick portions 112 that are made gradually thinner from the inner circumferential side to the outer circumferential side, it is possible to reduce separate vibrations occurring on the outer circumferential side, the inner circumferential side and in the radiation direction.

Figure 8:
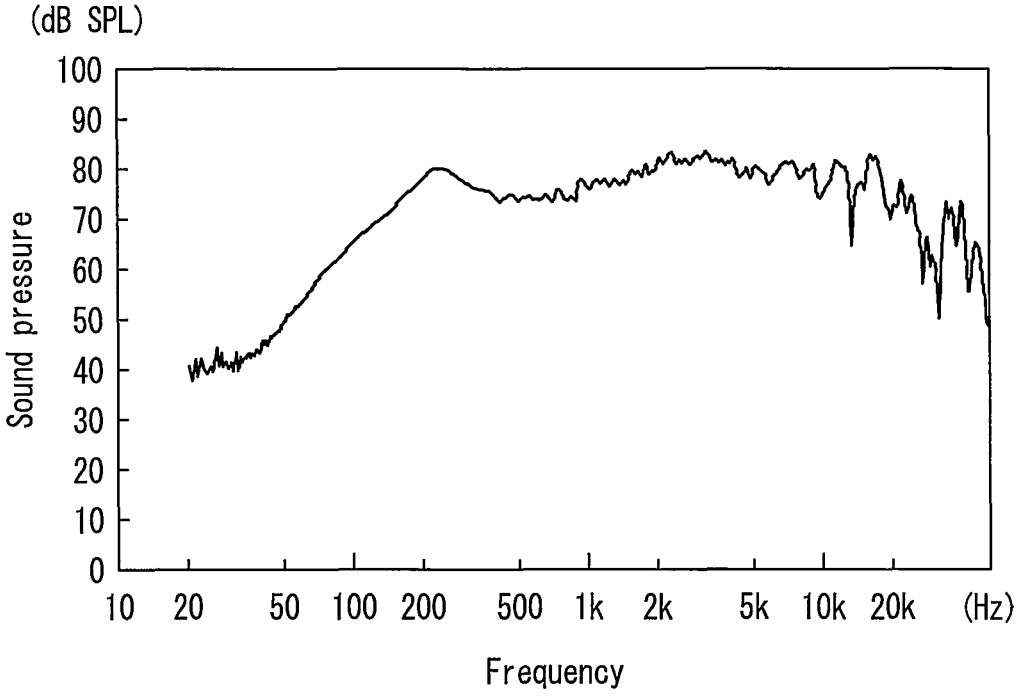
FIG. 8 is a graph showing a frequency response of the speaker device according to the present embodiment.
Figure 9:
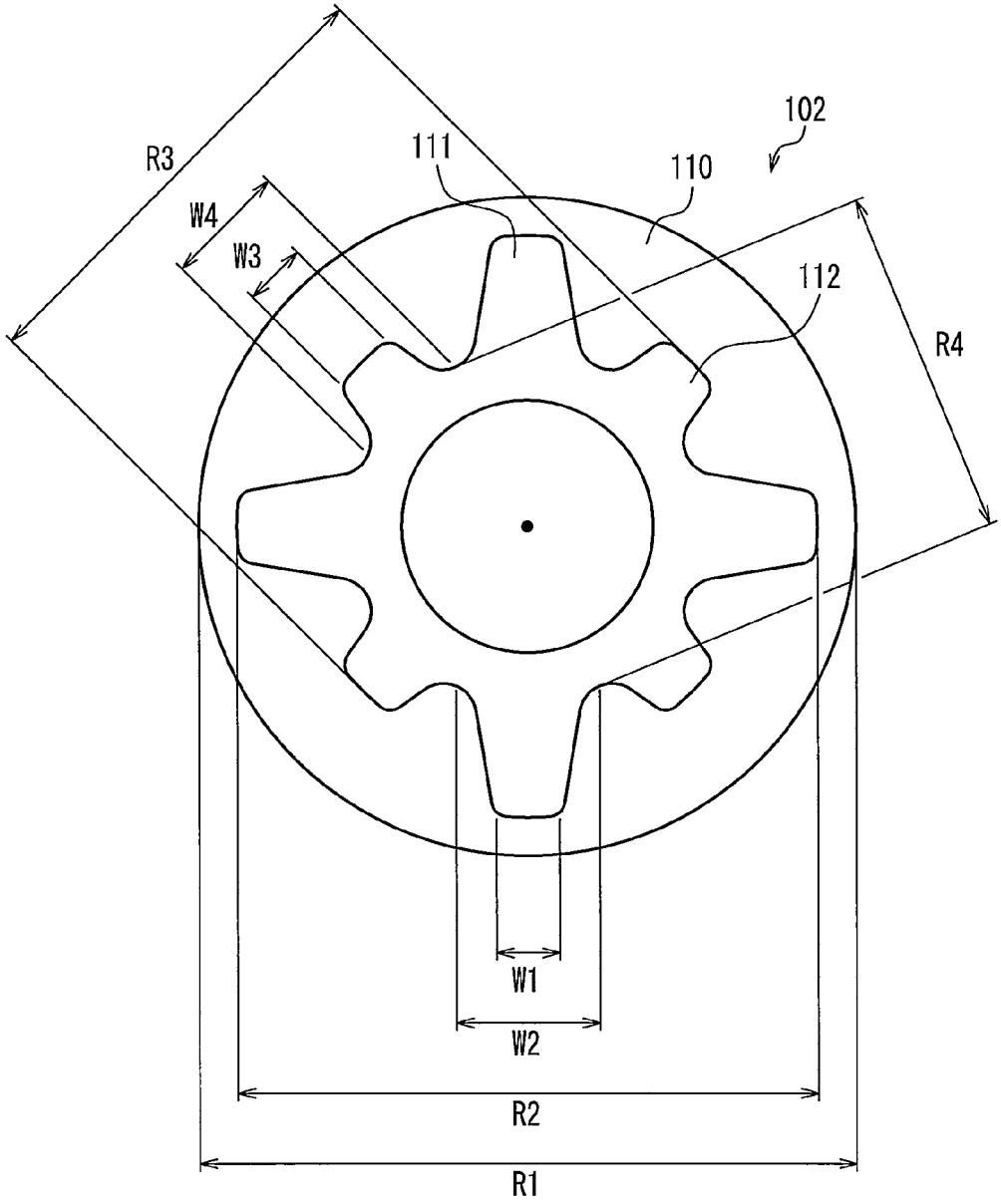
FIG. 9 is a plan view showing an exemplary diaphragm according to the present embodiment.

FIG. 8 is a graph showing the frequency response of the speaker device 100 of the present embodiment. FIG. 9 is a plan view of the diaphragm 102 in the speaker device 100 having the frequency response shown in FIG. 8. The diaphragm 102 shown in FIG. 9 is formed of polypropylene mixed with mica. An outermost diameter R1 of the diaphragm 102 shown in FIG. 9 is set at 47.0 mm. A distance R2 between the end portions of the opposed long thick portions 111 is set at 42.0 mm. A distance R3 between the end portions of the opposed short thick portions 112 is set at 33.0 mm. A distance R4 is set at 25.0 mm between opposed root portions between the long thick portion 111 and the short thick portion 112. A width W1 of a tip portion of the long thick portion 111 is set at 5.1 mm. A width W2 of a root portion of the long thick portion 111 is set at 8.0 mm. A width W3 of a tip portion of the short thick portion 112 is set at 5.1 mm. A width W4 of a root portion of the short thick portion 112 is set at 8.0 mm. The thickness T1 (see FIG. 4), which is the thickest part in the long thick portion 111, is set at 0.35 mm. The thickness T11 (see FIG. 5), which is the thickest part in the short thick portion 112, is set at 0.35 mm. The thickness T2 of the thin portion 110 (see FIGS. 4 and 5) is set at 0.2 mm. Note here that the above-described dimensions are examples.

Figure 10:
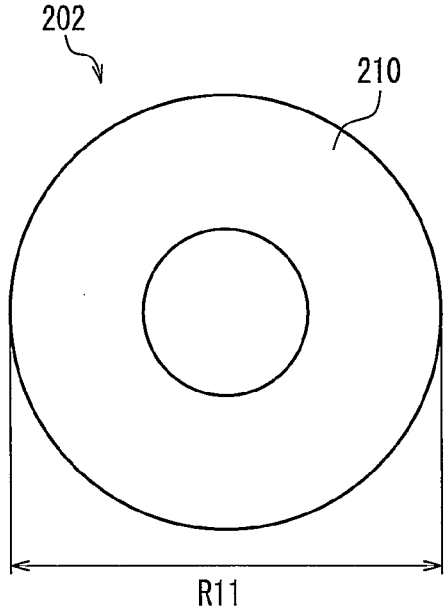
FIG. 10 is a plan view showing a diaphragm of a conventional speaker device.
Figure 11:
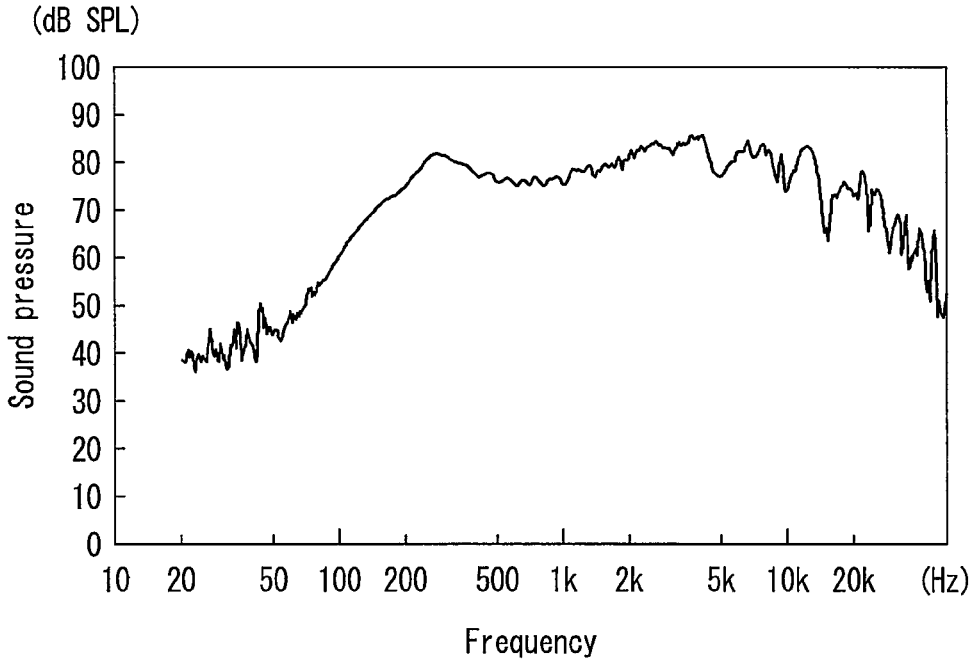
FIG. 11 is a graph showing a frequency response of the conventional speaker device.

Meanwhile, FIG. 10 is a plan view of a diaphragm 202 not provided with long thick portions and short thick portions. The diaphragm 202 is formed entirely of a thin portion 210 having a uniform thickness. An outermost diameter R11 of the diaphragm 202 is set at 47.0 mm. FIG. 11 is a graph showing the frequency response of a speaker device to which the diaphragm 202 shown in FIG. 10 is mounted.

In the speaker device provided with the diaphragm 202 shown in FIG. 10, separate vibrations occur in the diaphragm 202 in the band between the midrange (about 2 kHz) and the treble (about 20 kHz) as shown in FIG. 11, whereby large peaks and dips occur. On the other hand, in the speaker device provided with the diaphragm 102 shown in FIG. 9, separate vibrations are reduced in the band between the midrange and the treble as shown in FIG. 8, whereby peaks and dips of the sound pressure are reduced.

In other words, since the diaphragm 102 of the present embodiment is provided with the long thick portions 111, the strength of the diaphragm 102 on the outer circumferential side is improved, whereby separate vibrations occurring in the circumferential direction on the outer circumferential side can be reduced. Therefore, it is possible to improve the midrange frequency response. Further, since the diaphragm 102 of the present embodiment is provided with the short thick portions 112, the strength of the diaphragm 102 on the inner circumferential side is improved, whereby separate vibrations occurring in the circumferential direction on the inner circumferential side can be reduced. Therefore, it is possible to improve the treble frequency response. Further, since the long thick portions 111 and the short thick portions 112 of the diaphragm 102 of the present embodiment are formed to be gradually thinner from the inner circumferential side to the outer circumferential side, separate vibrations occurring in the radiation direction of the diaphragm 102 can be reduced. Therefore, it is possible to improve the midrange and the treble frequency responses.

[3. Effects of Embodiment, Etc]

In the present embodiment, the strength of the diaphragm 102 is enhanced by providing the long thick portions 111 and the short thick portions 112 to the diaphragm 102, whereby separate vibrations owing to the deformation of the diaphragm 102 can be reduced. Therefore, it is possible to stabilize the motion of the diaphragm 102 when generating sounds, which makes it possible to reduce fluctuations in the sound pressure of the speaker device.

Further, in the present embodiment, since the inner circumferential side of the diaphragm 102 is thicker than the outer circumferential side, the strength of the diaphragm 102 on the inner circumferential side is enhanced, whereby separate vibrations owing to the deformation of the diaphragm 102 on the inner circumferential side can be reduced. Therefore, it is possible to increase the sound pressure in the treble of the speaker device, which makes it possible to broaden the band on the treble side.

Further, in the present embodiment, since the diaphragm 102 is formed of a resin, the manufacture is easy using a molding method such as an injection molding. Therefore, the diaphragm 102 of the present embodiment is well-suited for mass production.

Further, in the long thick portion 111 and the short thick portion 112, since the width of the tip portion is smaller than the width of the root portion, an area between the tip portion and the root portion functions as a draft at the time of removing the diaphragm 102 from a die. Therefore, it is possible easily to remove the diaphragm 102 immediately after the molding from a die.

In the diaphragm 102 of the present embodiment, although the width W1 of the tip portion of the long thick portion 111 is smaller than the width W2 of the root portion thereof as shown in FIG. 9, the width W1 and the width W2 may have the same dimension. Moreover, although the width W3 of the tip portion of the short thick portion 112 is smaller than the width W4 of the root portion thereof, the width W3 and the width W4 may have the same dimension.

Further, in the present embodiment, although the long thick portions 111 and the short thick portions 112 are formed on the surface 102*a* of the diaphragm 102, the long thick portions 111 and the short thick portions 112 can be obscured by forming them on the back face 102*b*. That is, when the diaphragm 102 is mounted to the speaker device 100, the surface 102*a* is exposed to the outside. Therefore, forming the long thick portions 111 and the short thick portions 112 on the back face 102*b* is preferable for obscuring these thick portions.

Further, the present embodiment relates to a speaker device capable of reducing fluctuations in the sound pressure frequency response while broadening the reproduction band in the treble by providing a partially thick configuration to the diaphragm, and offers a speaker capable of reproducing sounds faithfully in accordance with input signals. Therefore, the speaker device of the present embodiment can be adapted not only to household audio devices, but also to a wide range of uses, such as in-car speakers, speakers for personal computers, professional-use speakers, etc.

The magnet 106 in the present embodiment is an example of the magnet. The voice coil 101 in the present embodiment is an example of the moving coil. The diaphragm 102 in the present embodiment is an example of the diaphragm. The long thick portion 111 and the short thick portion 112 in the present embodiment are examples of a plurality of thick portions. The long thick portion 111 is an example of the first thick portion. The short thick portion 112 is an example of the second thick portion. The displacement directions (directions indicated by the arrows A and B in FIG. 2) of the voice coil 101 and the diaphragm 102 in the present embodiment are examples of the displacement directions (predetermined directions) of the moving coil and the diaphragm.

The disclosure of the present application is useful for a diaphragm and a speaker device.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A diaphragm comprising:

an outer portion surrounding an inner portion, wherein the inner portion has a thickness that becomes gradually thinner along a radial direction from inner circumferential side of the diaphragm to the outer portion, wherein the thickness of the inner portion and a thickness of the outer portion are equal at a position where the outer portion and the inner portion meet, and the inner portion includes at least two different radial lengths extending from the inner circumferential side to the outer portion.

2. A speaker device comprising:

a magnet;

a moving coil that is displaceable in a first direction based on an input current and magnetic flux generated by the magnet; and a diaphragm that is displaceable in the first direction together with the moving coil, wherein the diaphragm includes an outer portion surrounding an inner portion, wherein the inner portion has a thickness that becomes gradually thinner along a radial direction from an inner circumferential side of the diaphragm to the outer portion, wherein the thickness of the inner portion and a thickness of the outer portion equal at a position where the outer portion and the inner portion meet, and the inner portion includes at least two different radial lengths extending from the inner circumferential side to the outer portion.

* * * * *